US011231659B2

(12) United States Patent
Sumida et al.

(10) Patent No.: US 11,231,659 B2
(45) Date of Patent: Jan. 25, 2022

(54) IMAGE FORMING APPARATUS WHICH SWITCHES FROM COLOR TO MONOCHROME MODE WITH CHARGING AND DEVELOPING BIAS REDUCTION

(71) Applicant: BROTHER KOGYO KABUSHIKI KAISHA, Nagoya (JP)

(72) Inventors: Junya Sumida, Ama (JP); Shunsuke Ishii, Nagoya (JP); Toshio Furukawa, Nagoya (JP); Toshiyuki Sano, Iwakura (JP); Shintaro Sakaguchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 17/159,567

(22) Filed: Jan. 27, 2021

(65) Prior Publication Data

US 2021/0302857 A1 Sep. 30, 2021

(30) Foreign Application Priority Data

Mar. 26, 2020 (JP) ..... JP2020-055292

(51) Int. Cl.

*G03G 15/01* (2006.01)
*G03G 15/00* (2006.01)
*G03G 15/02* (2006.01)

(52) U.S. Cl.

CPC ..... *G03G 15/0178* (2013.01); *G03G 15/0266* (2013.01); *G03G 15/5004* (2013.01); *G03G 2215/0119* (2013.01)

(58) Field of Classification Search

CPC ..... G03G 15/0178; G03G 15/0266; G03G 15/5004; G03G 2215/0119; G03G 2221/1603; G06K 15/129

(Continued)

(56) References Cited

U.S. PATENT DOCUMENTS

2004/0042813 A1 3/2004 Takai
2004/0136742 A1* 7/2004 Saito ..... G03G 15/0126 399/55

(Continued)

FOREIGN PATENT DOCUMENTS

JP 2001-022240 A 1/2001
JP 2004-085976 A 3/2004

(Continued)

*Primary Examiner* — Robert B Beatty
(74) *Attorney, Agent, or Firm* — Scully, Scott, Murphy & Presser, PC

(57) ABSTRACT

In response to determining that image forming in a color mode is performed on a first sheet and then image forming in a monochrome mode is successively performed on the second sheet, perform charging bias reduction processing gradually reducing a charging bias from first to second charging bias and developing bias reduction processing of gradually reducing a developing bias from first to second developing bias during a first inter-sheet period after the first sheet passes a first photosensitive drum and before the second sheet reaches the first photosensitive drum, and perform separation processing such that an execution period of the separation processing overlaps at least one of an execution period of the charging bias reduction processing and an execution period of the developing bias reduction processing, the separation processing being processing of controlling a moving mechanism to move a first developing roller from a contact position to a separation position.

20 Claims, 7 Drawing Sheets

(58) Field of Classification Search
USPC ..... 399/54, 228, 299
See application file for complete search history.

(56) References Cited

U.S. PATENT DOCUMENTS

| | | | | |
|---|---|---|---|---|
| 2010/0303488 | A1 | 12/2010 | Yanagi | |
| 2016/0048091 | A1* | 2/2016 | Ishii | G03G 15/0266 399/50 |
| 2016/0116859 | A1* | 4/2016 | Kobayashi | G03G 15/0178 399/285 |
| 2016/0139531 | A1* | 5/2016 | Shimazoe | G03G 15/0266 399/50 |
| 2017/0038700 | A1* | 2/2017 | Takahashi | G03G 15/0266 |
| 2017/0308008 | A1* | 10/2017 | Aiba | G03G 15/0189 |
| 2019/0286031 | A1* | 9/2019 | Mukai | G03G 15/0189 |

FOREIGN PATENT DOCUMENTS

| | | | |
|---|---|---|---|
| JP | 2009-258432 | A | 11/2009 |
| JP | 2011-008224 | A | 1/2011 |

* cited by examiner

IMAGE FORMING APPARATUS WHICH SWITCHES FROM COLOR TO MONOCHROME MODE WITH CHARGING AND DEVELOPING BIAS REDUCTION

CROSS REFERENCE TO RELATED APPLICATIONS

This application claims priority from Japanese Patent Application No. 2020-055292 filed Mar. 26, 2020. The entire content of the priority application is incorporated herein by reference.

TECHNICAL FIELD

This disclosure relates to an image forming apparatus.

BACKGROUND

An image forming apparatus is conventionally known that is configured to perform separation processing for separating a developing roller from a photosensitive drum by a separation mechanism and contact processing for bringing the developing roller into contact with the photosensitive drum by the separation mechanism.

SUMMARY

According to one aspect, this specification discloses an image forming apparatus configured to form an image on a sheet. The image forming apparatus includes a first photosensitive drum, a first developing roller, a first charger, a second photosensitive drum, a second developing roller, a second charger, a moving mechanism, and a controller. The first developing roller is movable between a contact position at which the first developing roller contacts the first photosensitive drum and a separation position which is apart from the contact position. The first charger is configured to charge the first photosensitive drum. The second charger is configured to charge the second photosensitive drum. The moving mechanism is configured to move the first developing roller between the contact position and the separation position. The controller is configured to switch a printing mode between a color mode in which the first and second developing rollers are at contact positions at which the first and second developing rollers contact the first and second photosensitive drums, respectively, and a monochrome mode in which the first developing roller is at the separation position and the second developing roller is at the contact position. The controller is configured to: determine whether an image forming in the color mode is performed on a first sheet and then an image forming in the monochrome mode is successively performed on a second sheet; and in response to determining that the image forming in the color mode is performed on the first sheet and then the image forming in the monochrome mode is successively performed on the second sheet, perform charging bias reduction processing and developing bias reduction processing during a first inter-sheet period after the first sheet passes the first photosensitive drum and before the second sheet reaches the first photosensitive drum, the charging bias reduction processing being processing of gradually reducing a charging bias applied to the first charger from a first charging bias to a second charging bias, the developing bias reduction processing being processing of gradually reducing a developing bias applied to the first developing roller from a first developing bias to a second developing bias; and perform separation processing such that an execution period of the separation processing overlaps at least one of an execution period of the charging bias reduction processing and an execution period of the developing bias reduction processing, the separation processing being processing of controlling the moving mechanism to move the first developing roller from the contact position to the separation position.

BRIEF DESCRIPTION OF THE DRAWINGS

Embodiments in accordance with this disclosure will be described in detail with reference to the following figures wherein.

DETAILED DESCRIPTION

When the developing roller is separated from the photosensitive drum, the developing by the developing roller is not executed. Thus, it is conceivable to change a charging bias for charging the photosensitive drum and a developing bias applied to the developing roller to smaller values than the values used at printing. Thus, it is conceivable to change each bias to a value smaller than the value used at printing in the separation processing, and to change each bias to a value suitable for printing in the contact processing.

However, if the charging bias and developing bias are changed in a square wave in a state where the developing roller is in contact with the photosensitive drum, the toner on the developing roller may adhere to the photosensitive drum. In order to prevent such a problem from occurring, for example, it is conceivable to separate the period of executing the separation processing or the contact processing from the change timing of each bias with a margin. However, in this case, there arises a problem that the interval between sheets in successive printing cannot be reduced.

In view of the foregoing, an aspect of an objective of this disclosure is to suppress toner on a developing roller from adhering to a photosensitive drum and to reduce an interval between sheets.

Hereinafter, an embodiment of this disclosure will be described in detail with reference to the drawings as appropriate.

Figure 1:
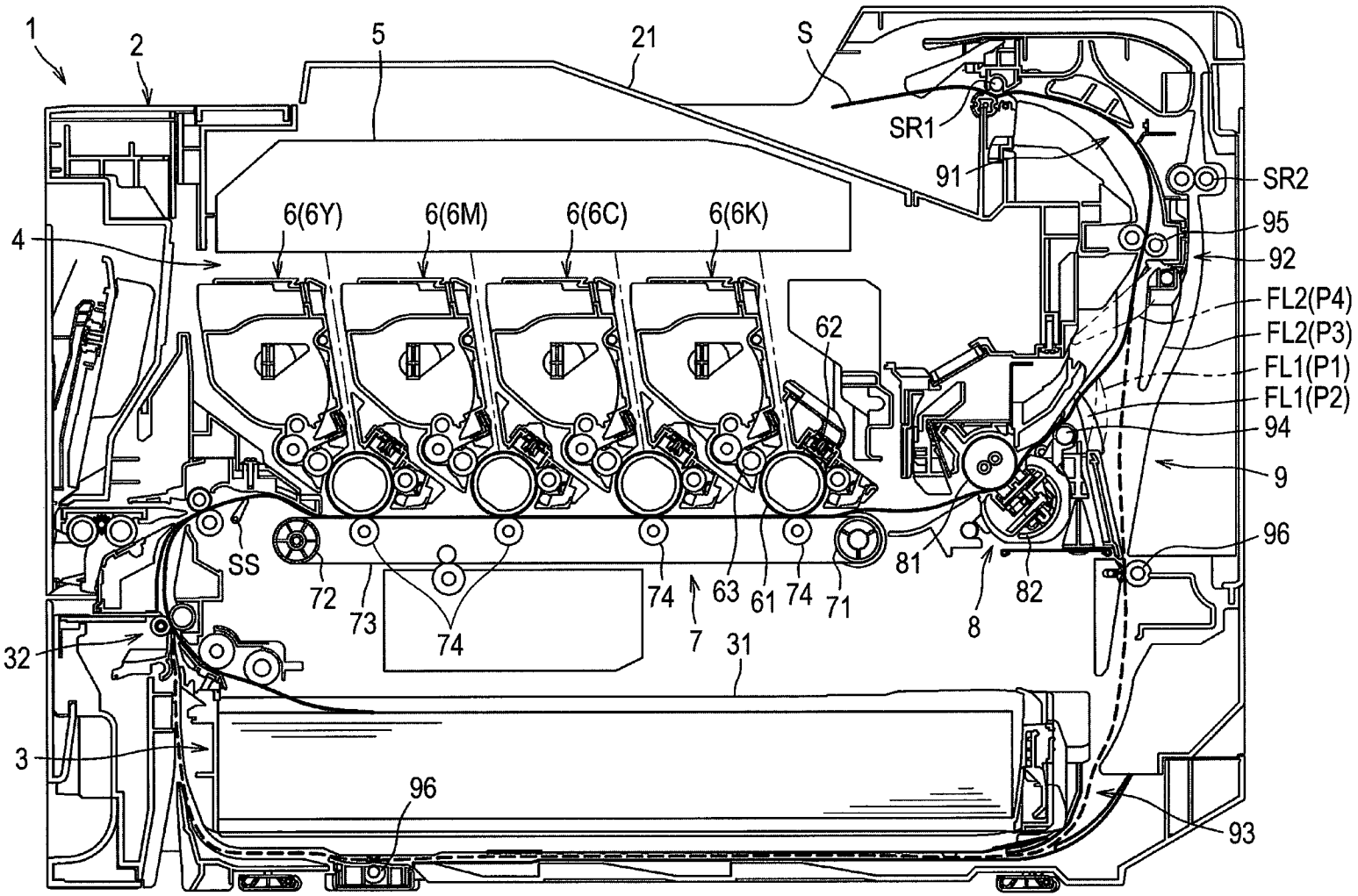
FIG. 1 is a schematic diagram showing a color printer according to an embodiment of this disclosure.

As shown in FIG. 1, a color printer 1 as an example of an image forming apparatus is configured to perform color printing and monochrome printing and to form an image on both sides of a sheet S. The color printer 1 includes a main housing 2, a supply unit 3, an image forming unit 4, a fixing device 8, and a conveyance unit 9 arranged inside the main housing 2. The main housing 2 has a discharge tray 21 on the upper surface thereof.

The supply unit 3 is provided in the lower part of the main housing 2, and includes a supply tray 31 for accommodating the sheet S and a supply mechanism 32 for supplying the sheet S in the supply tray 31 to the image forming unit 4.

The image forming unit 4 has a function of transferring a toner image to the sheet S to form an image, and includes an exposure device 5, four process units 6, and a transfer unit 7.

The exposure device 5 is arranged in the upper part of the main housing 2 and includes a light source (not shown), a polygon mirror, and so on. The exposure device 5 exposes the surface of a photosensitive drum 61 by irradiating the surface of the photosensitive drum 61 with light.

The process unit 6 includes the photosensitive drum 61, a charger 62, and a developing roller 63. Toner of respective colors of yellow, magenta, cyan and black is contained in the four process units 6.

Regarding the process units 6, the process units 6Y, 6M, 6C, and 6K containing toner of respective colors of yellow, magenta, cyan, and black are arranged in this order from the upstream in the conveyance direction of the sheet S. In the present specification and drawings, when the photosensitive drums 61, the developing rollers 63, and so on corresponding to the colors of toner are specified, the symbols Y, M, C, and K for yellow, magenta, cyan, and black, respectively, will be added.

Figure 2A:
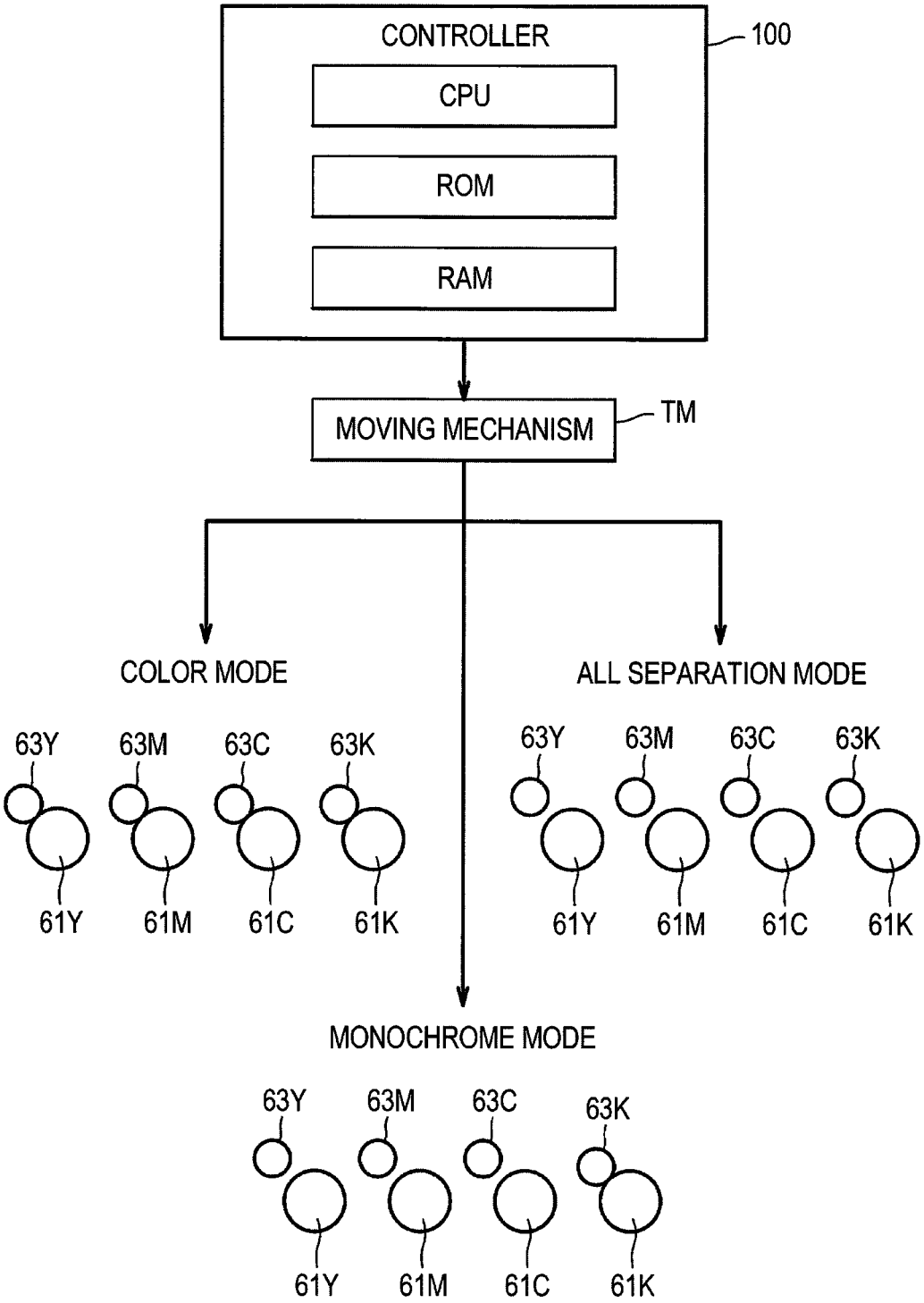
FIG. 2A is a schematic diagram showing a separation state and a contact state between photosensitive drums and developing rollers.

As shown in FIG. 2A, the developing roller 63 is configured to move between a contact position at which the developing roller 63 contacts the photosensitive drum 61 and a separation position at which the developing roller 63 separates from the photosensitive drum 61. The color printer 1 further includes a moving mechanism (separation and contact mechanism) TM and a controller 100. The moving mechanism TM is a mechanism that moves the developing roller 63 between the contact position and the separation position. The controller 100 has a CPU, a ROM, a RAM, and so on, and is configured to execute various processing in response to the reception of a print command and so on according to a program prepared in advance. The controller 100 controls the moving mechanism TM.

Figure 2B:
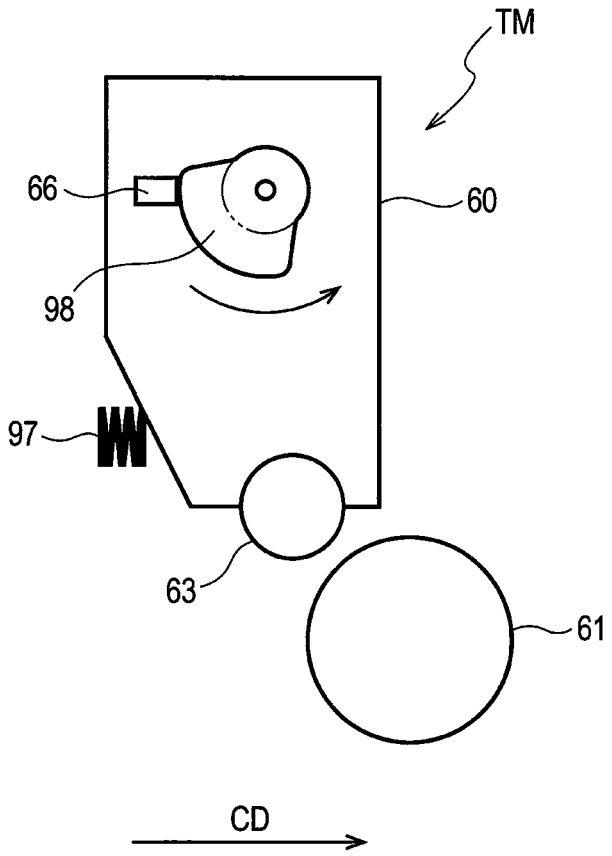
FIG. 2B is a schematic diagram showing an example of a configuration of a moving mechanism.

FIG. 2B shows an example of the configuration of the moving mechanism TM. The developing roller 63 is rotatably supported by a developing roller support member 60. A cam 98 and a spring 97 are provided at the main housing 2 side. The rotational position of the cam 98 is controlled by the controller 100. The spring 97 urges the developing roller support member 60 in a direction from the upstream side toward the downstream side in the conveyance direction CD of the sheet S. A pressed portion 66 is provided at the developing roller support member 60. The pressed portion 66 protrudes outward in the axial direction of the developing roller 63 from the developing roller support member 60. When the pressed portion 66 (that is, the developing roller support member 60) is pressed by the cam 98 from the downstream side toward the upstream side in the conveyance direction CD, the developing roller support member 60 moves to a separation position where the developing roller 63 is separated from the photosensitive drum 61, against the urging force of the spring 97. When the pressure by the cam 98 is released, the developing roller support member 60 moves to a contact position where the developing roller 63 contacts the photosensitive drum 61 due to the urging force of the spring 97.

Specifically, the controller 100 executes a color mode, a monochrome mode, and an all separation mode. In the color mode in which color printing is performed, the controller 100 controls such that all the developing rollers 63Y, 63M, 63C, and 63K contact the corresponding photosensitive drums 61Y, 61M, 61C, and 61K. In the monochrome mode in which the controller 100 performs monochrome printing, the controller 100 controls such that only the developing roller 63K for black contacts the photosensitive drum 61K, and the other three colors developing rollers 63Y, 63M, and 63C separate from the corresponding photosensitive drums 61Y, 61M, and 61C. That is, the photosensitive drums 61Y, 61M, and 61C are used only for color printing. Further, when cleaning the photosensitive drums 61, for example, the controller 100 executes the all separation mode to separate all the developing rollers 63Y, 63M, 63C, and 63K from the corresponding photosensitive drums 61Y, 61M, 61C, and 61K, respectively.

As shown in FIG. 1, the transfer unit 7 includes a drive roller 71, a follow roller 72, a conveyance belt 73, and four transfer rollers 74. The conveyance belt 73 is an endless belt, and is stretched between the drive roller 71 and the follow roller 72. Inside the conveyance belt 73, the transfer rollers 74 are arranged so as to sandwich the conveyance belt 73 with the corresponding photosensitive drums 61.

The charger 62 charges the surface of the photosensitive drum 61. After that, the exposure device 5 exposes the surface of the photosensitive drum 61 to form an electrostatic latent image based on image data on the surface of the photosensitive drum 61.

The developing roller 63 supplies toner to the electrostatic latent image formed on the photosensitive drum 61. As a result, a toner image is formed on the photosensitive drum 61. After that, when the sheet S is conveyed between the photosensitive drum 61 and the transfer roller 74 by the conveyance belt 73, the toner image on the photosensitive drum 61 is transferred onto the sheet S.

A sheet sensor SS for detecting the presence or absence of the sheet S is provided upstream of the image forming unit 4 in the conveyance direction of the sheet S. The sheet sensor SS includes a swing lever that is pushed by the conveyed sheet S and swings, for example, and an optical sensor that detects the swing of the swing lever. In this embodiment, it is assumed that the sheet sensor SS is ON while the sheet S is passing, that is, when the swing lever is tilted by the sheet S, and that the sheet sensor SS is OFF while the sheet S is not passing, that is, when the swing lever is not tilted by the sheet S. The relationship between the posture of the swing lever and ON and OFF of the sheet sensor SS may be reversed.

The fixing device 8 is a device that thermally fixes the toner image on the sheet S. The fixing device 8 includes a heating roller 81 and a pressure roller 82 that sandwiches the sheet S with the heating rollers 81.

The conveyance unit 9 is configured to convey the sheet S discharged from the fixing device 8 to the outside of the main housing 2 or to the image forming unit 4 again. The conveyance unit 9 includes a first conveyance path 91, a second conveyance path 92, a reconveyance path 93, first conveyance rollers 94, a second conveyance roller 95, a first switchback roller SR1, and a second switchback roller SR2, a plurality of reconveyance rollers 96, a first flapper FL1, and a second flapper FL2.

The first conveyance path 91 is a path that guides the sheet discharged from the fixing device 8 toward the discharge tray 21. The second conveyance path 92 is a path that guides the sheet discharged from the fixing device 8 toward the discharge tray 21 by a route different from the first conveyance path 91. The reconveyance path 93 is a path that guides the sheet S drawn into the main housing 2 by the first switchback roller SR1 and so on described later, to the supply mechanism 32 on the upstream side of the image forming unit 4. The reconveyance rollers 96 are rollers that convey the sheet S in the reconveyance path 93 toward the supply mechanism 32, and are provided in the reconveyance path 93.

The first conveyance roller 94 is provided in the fixing device 8. The first conveyance roller 94 conveys the sheet S on which the toner image is thermally fixed toward the second flapper FL2.

The second conveyance roller 95, the first switchback roller SR1 and the second switchback roller SR2 are configured to rotate in the forward and reverse directions. The second conveyance roller 95, the first switch back roller SR1, and the second switch back roller SR2 convey the sheet S to the outside of the main housing 2 during forward rotation, specifically toward the discharge tray 21, and draw the sheet S into the main housing 2 during reverse rotation.

The second conveyance roller 95 and the first switchback roller SR1 are provided in the first conveyance path 91. The first switchback roller SR1 is arranged closer to the discharge tray 21 than the second conveyance roller 95 is. The second switchback roller SR2 is provided in the second conveyance path 92.

The first flapper FL1 is rotatable between a first position P1 shown by the double-dot chain line and a second position P2 shown by the solid line. When the first flapper FL1 is located at the first position P1, the first flapper FL1 guides the sheet S discharged from the fixing device 8 toward the second flapper FL2. When the first flapper FL1 is located at the second position P2, the first flapper FL1 prevents the sheet S drawn into the main housing 2 by the first switchback roller SR1 or the second switchback roller SR2 from being conveyed toward the fixing device 8.

The second flapper FL2 is rotatable between a third position P3 shown by the solid line and a fourth position P4 shown by the double-dot chain line. When the second flapper FL2 is located at the third position P3, the second flapper FL2 guides the sheet S discharged from the fixing device 8 toward the first switchback roller SR1. When the second flapper FL2 is located at the fourth position P4, the second flapper FL2 guides the sheet S discharged from the fixing device 8 toward the second switchback roller SR2.

The first flapper FL1 is urged from the first position P1 toward the second position P2 by a spring (not shown). When the sheet S discharged from the fixing device 8 pushes the first flapper FL1 against the urging force of the spring, the first flapper FL1 rotates from the second position P2 to the first position P1. Then, when the trailing end of the sheet S separates from the first flapper FL1, the first flapper FL1 rotates from the first position P1 to the second position P2 by the urging force of the spring. The second flapper FL2 is configured to be switched between the third position P3 and the fourth position P4 by the controller 100.

The controller 100 is configured to execute separation processing, charging bias reduction processing, and developing bias reduction processing.

The separation processing is a processing that moves the developing roller 63 from the contact position to the separation position by the moving mechanism TM.

The charging bias reduction processing is a processing for gradually reducing the charging bias applied to the charger 62. Specifically, in the charging bias reduction processing, the controller 100 reduces the charging bias from a first charging bias suitable for printing to a second charging bias lower than the first charging bias with a first gradient G1 shown in FIG. 5.

The developing bias reduction processing is a processing for gradually reducing the developing bias applied to the developing roller 63. Specifically, in the developing bias reduction processing, the controller 100 reduces the developing bias from a first developing bias suitable for printing to a second developing bias lower than the first developing bias with a second gradient G2 shown in FIG. 5.

The controller 100 executes the charging bias reduction processing and the developing bias reduction processing such that the difference between the charging bias and the developing bias is within a first range. In this embodiment, the first gradient G1 and the second gradient G2 are set to the same gradient. However, as long as the difference between the charging bias and the developing bias is within the first range, the first gradient G1 and the second gradient G2 may be set to different gradients.

When performing color printing and then successively performing monochrome printing, the controller 100 executes the above-mentioned separation processing, charging bias reduction processing, and developing bias reduction processing for each of the developing rollers 63Y, 63M, and 63C and the chargers 62Y, 62M, and 62C, which are used only for color printing. Since the separation processing, the charging bias reduction processing, and the developing bias reduction processing performed for each color of yellow, magenta, and cyan are the same processing, each processing for yellow will be described below and the descriptions of each processing for the other colors are omitted.

Figure 5:
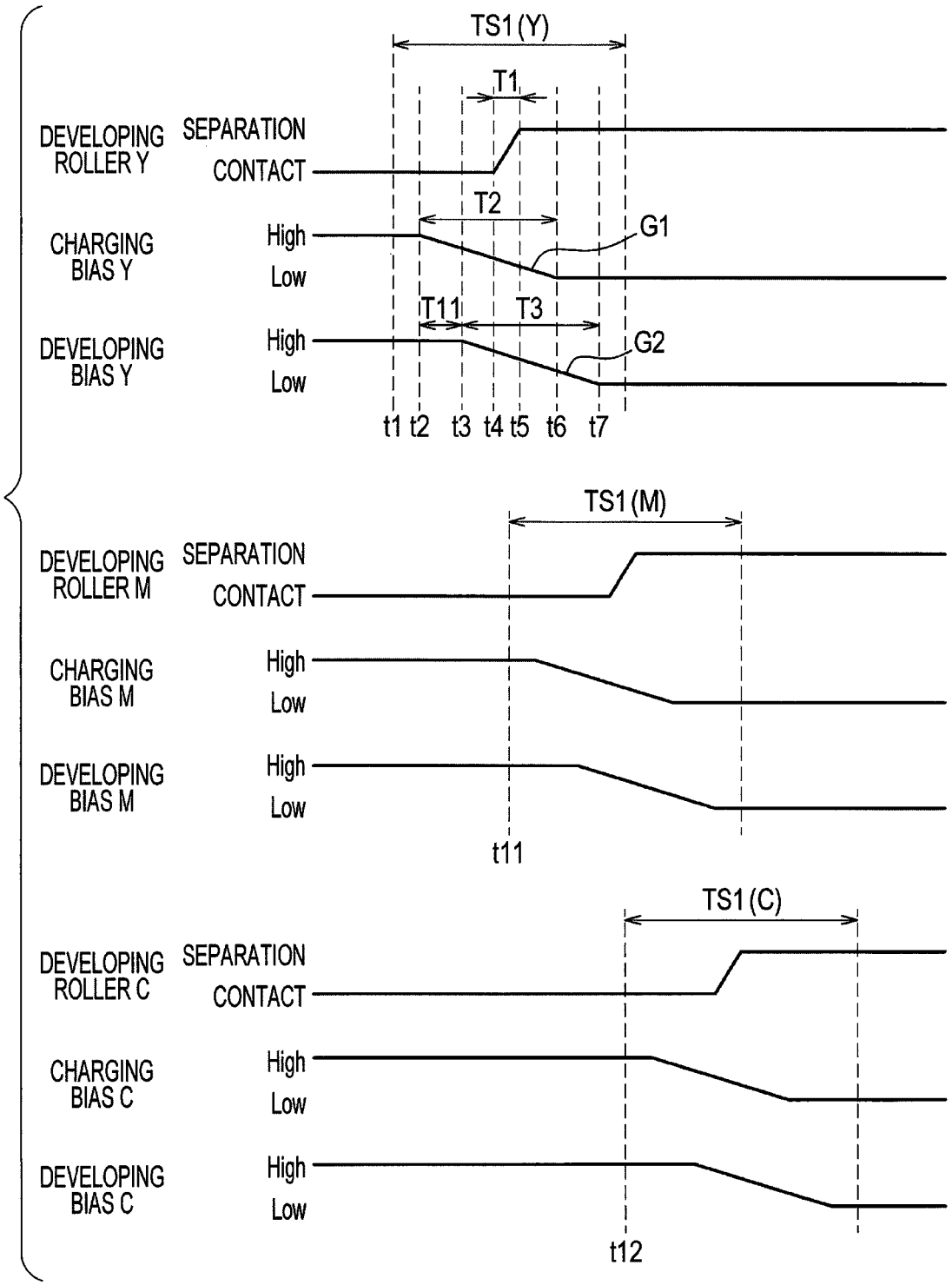
FIG. 5 is a time chart showing each processing in a case of switching from color printing to monochrome printing in successive print processing.

When performing color printing on a first sheet and then successively performing monochrome printing on a second sheet, as shown in FIG. 5, the controller 100 executes the charging bias reduction processing and the developing bias reduction processing for the charger 62Y and developing roller 63Y in a first inter-sheet period TS1 that is after the first sheet has passed the photosensitive drum 61Y and before the second sheet reaches the photosensitive drum 61Y.

Specifically, during the first inter-sheet period TS1, the controller 100 performs the charging bias reduction processing and the developing bias reduction processing such that an execution period T2 of the charging bias reduction processing and an execution period T3 of the developing bias reduction processing overlap each other. Further, the controller 100 has a function of performing the separation processing such that an execution period T1 of the separation processing on the developing roller 63Y overlaps each (both) of the execution periods T2 and T3 of the charging bias reduction processing and the developing bias reduction processing for the charger 62Y and the developing roller 63Y.

Here, "after the first sheet passes the photosensitive drum 61Y" means the time after the trailing end of the first sheet reaches the photosensitive drum 61Y, and "before the second sheet reaches the photosensitive drum 61Y" means the time before the leading end of the second sheet reaches the photosensitive drum 61Y. In other words, the first inter-sheet period TS1 means the time corresponding to an interval (distance) from the trailing end of the first sheet to the leading end of the second sheet. The first inter-sheet period TS1 is preliminarily set. For example, the first inter-sheet period TS1 is set as appropriate according to an interval of sheets which is set according to a printing speed, an interval of sheets which is set for double-sided printing, and so on. In other words, as the first inter-sheet period TS1, a plurality of different periods may be set.

The first sheet is a sheet corresponding to a particular page, and the second sheet is a sheet corresponding to a page that is printed subsequently to the particular page. For example, when double-sided printing is performed on one sheet, the first sheet and the second sheet may be the same sheet.

The controller 100 performs contact processing, charging bias increase processing and developing bias increase processing.

The contact processing is processing in which the developing roller 63 is moved by the moving mechanism TM from the separation position to the contact position.

The charging bias increase processing is processing in which the charging bias that is applied to the charger 62 is gradually increased. Specifically, in the charging bias increase processing, the controller 100 increases the charging bias from the second charging bias toward the first charging bias with a third gradient G3 shown in FIG. 6.

The developing bias increase processing is processing in which the developing bias that is applied to the developing roller 63 is gradually increased. Specifically, in the developing bias increase processing, the controller 100 increases the developing bias from the second developing bias toward the first developing bias with a fourth gradient G4 shown in FIG. 6.

The controller 100 performs the charging bias increase processing and the developing bias increase processing such that the difference between the charging bias and the developing bias falls within a second range. In the present embodiment, the third gradient G3 and the fourth gradient G4 are set to the same gradient. However, as long as the difference between the charging bias and the developing bias falls within the second range, the third gradient G3 and the fourth gradient G4 may be set to different gradients.

When color printing is performed successively after monochrome printing, the controller 100 performs the contact processing, the charging bias increase processing, and the developing bias increase processing described above on each of the developing rollers 63Y, 63M and 63C and the chargers 62Y, 62M and 62C which are used only for color printing. Since the contact processing, the charging bias increase processing, and the developing bias increase processing which are performed on each of the colors yellow, magenta and cyan are the same processing, in the following discussion, a description will be given of each processing in relation to yellow as a typical example, and any description of the processing in relation to the other colors will be omitted.

Figure 6:
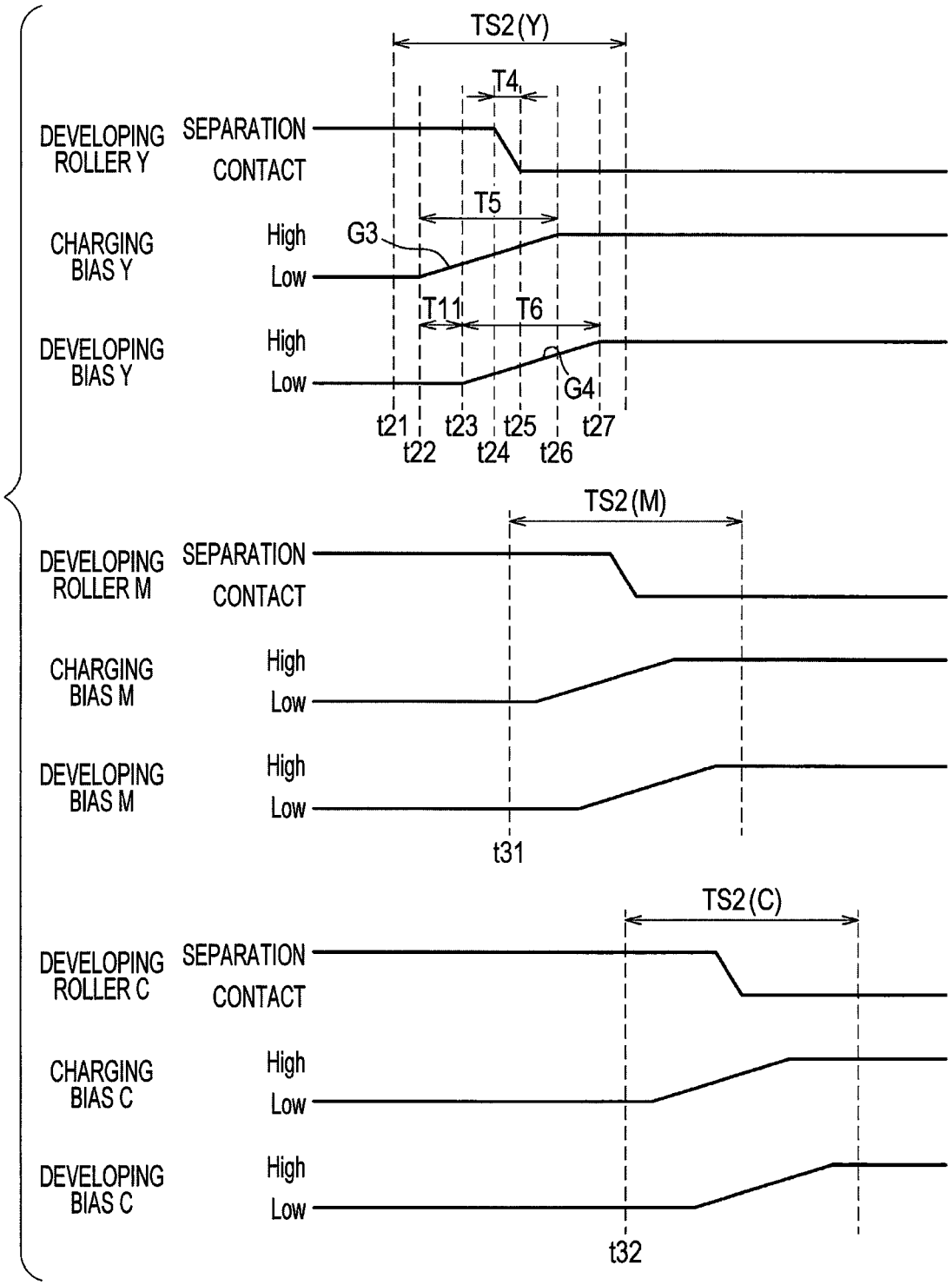
FIG. 6 is a time chart showing each processing in a case of switching from monochrome printing to color printing in successive print processing.

When color printing is performed on the fourth sheet successively after monochrome printing is performed on the third sheet, as shown in FIG. 6, the controller 100 has a function of performing, during a second inter-sheet period TS2 after the third sheet passes the photosensitive drum 61Y and before the fourth sheet reaches the photosensitive drum 61Y, the charging bias increase processing and the developing bias increase processing on the charger 62Y and the developing roller 63Y.

Specifically, during the second inter-sheet period TS2, the controller 100 performs the charging bias increase processing and the developing bias increase processing such that an execution period T5 of the charging bias increase processing and an execution period T6 of the developing bias increase processing overlap each other. Further, the controller 100 has a function of performing the contact processing such that an execution period T4 of the contact processing on the charger 62Y and the developing roller 63Y overlaps each (both) of the execution period T5 of the charging bias increase processing and the execution period T6 of the developing bias increase processing on the charger 62Y and the developing roller 63Y.

Here, "after the third sheet passes the photosensitive drum 61Y" means the time after the trailing end of the third sheet reaches the photosensitive drum 61Y, and "before the fourth sheet reaches the photosensitive drum 61Y" means the time before the leading end of the fourth sheet reaches the photosensitive drum 61Y. In other words, the second inter-sheet period TS2 means a time corresponding to an interval (distance) from the trailing end of the third sheet to the leading end of the fourth sheet. The second inter-sheet period TS2 is preliminarily set. The second inter-sheet period TS2 is set in a similar manner to the first inter-sheet period TS1 described previously.

The third sheet is a sheet corresponding to a particular page, and the fourth sheet is a sheet corresponding to a page that is printed subsequently to the particular page. For example, when double-sided printing is performed on one sheet, the third sheet and the fourth sheet may be the same sheet.

The operation of the controller 100 will be described next in detail. The controller 100 repeatedly performs the processing shown in FIG. 3. Before the reception of the print command, each of the developing rollers 63 is located in the separation position.

Figure 3:
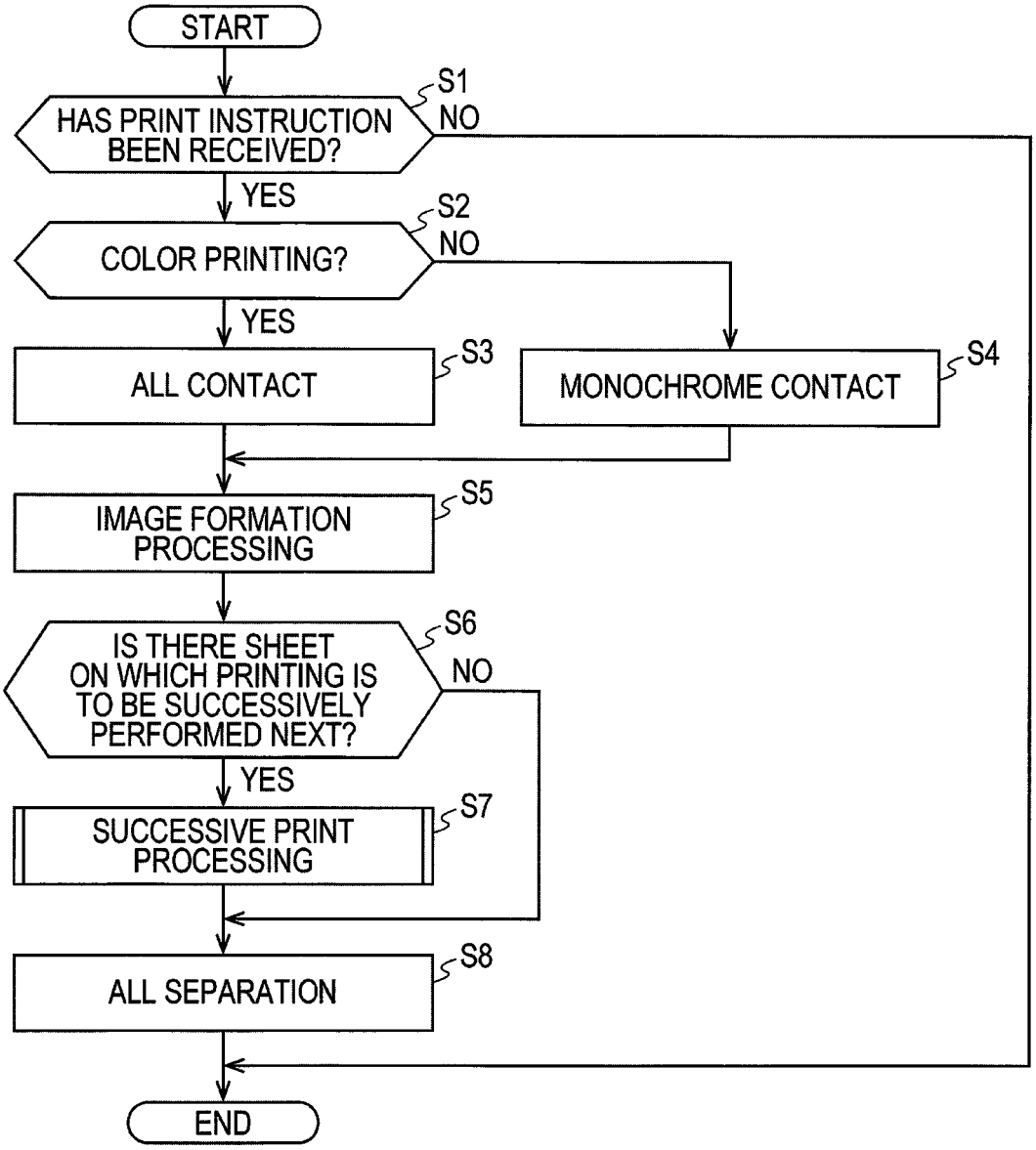
FIG. 3 is a flowchart showing operations of a controller.

In the processing shown in FIG. 3, the controller 100 first determines whether a print command has been received (S1). In response to determining in S1 that a print command has not been received (S1: No), the controller 100 ends the present processing.

In response to determining in S1 that a print command has been received (S1: Yes), the controller 100 determines whether the printing to be performed on the first sheet S is color printing (S2). In response to determining in S2 that color printing is to be performed (S2: Yes), the controller 100 causes each of the developing rollers 63 to contact each of the photosensitive drums 61 (S3). In response to determining in S2 that color printing is not to be performed (S2: No), the controller 100 causes only the developing roller 63K for black to contact the photosensitive drum 61K (S4).

After S3 or S4, the controller 100 causes each of the photosensitive drums 61, each of the developing rollers 63, and so on to rotate, and controls the exposure device 5 and so on to perform image formation processing which forms an image on the first sheet S (S5). Specifically, when color printing is performed in S5, the controller 100 sets each of the charging biases to the first charging bias, and sets each of the developing biases to the first developing bias. When monochrome printing is performed in S5, the controller 100 sets the charging bias and the developing bias for black (K) to the first charging bias and the first developing bias, and sets the charging biases and the developing biases for the other colors (Y, M and C) to the second charging bias and the second developing bias.

After S5, the controller 100 determines whether there is a sheet S on which printing is to be successively performed (S6). In response to determining in S6 that there is a sheet S on which printing is to be successively performed (S6: Yes), the controller 100 performs successive print processing (S7). The successive print processing will be described later.

After executing S7 or in response to determining in S6 that there is no sheet S on which printing is to be successively performed (S6: No), the controller 100 separates each of the developing rollers 63 from each of the photosensitive drums 61 (S8) so as to end the present processing. In S8, the processing necessary for completing the image formation processing, such as processing for stopping the rotational driving of the photosensitive drums 61 and so on, is performed.

Figure 4:
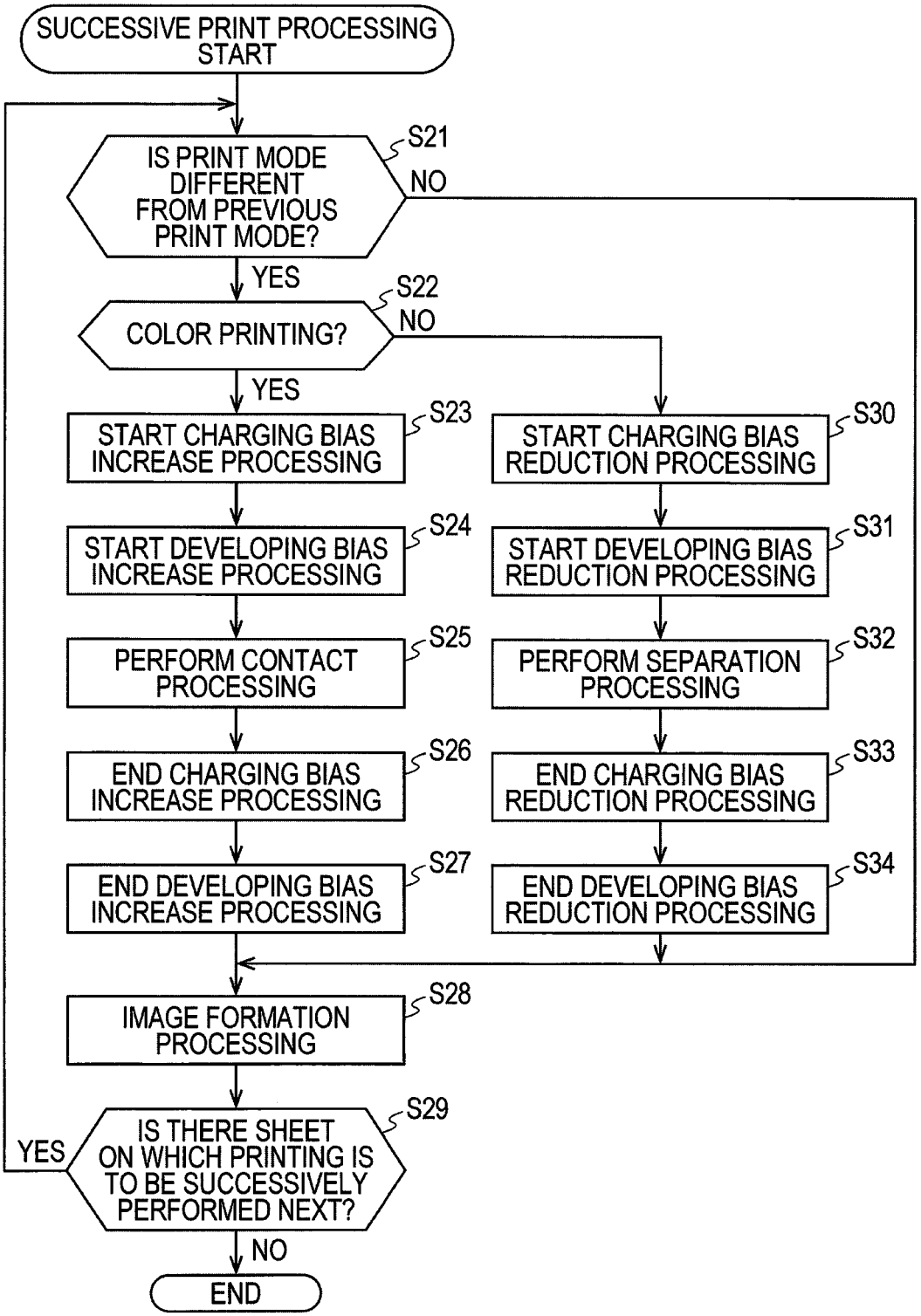
FIG. 4 is a flowchart showing successive print processing.

As shown in FIG. 4, in the successive print processing, the controller 100 first determines whether the print mode is different from the previous print mode (S21). In response to determining in S21 that the print mode is different from the previous print mode (S21: Yes), the controller 100 determines whether the print mode this time is color printing (S22).

In response to determining in S22 that the print mode is not color printing (S22: No), that is, when color printing is switched to monochrome printing, the controller 100 starts the charging bias reduction processing on the chargers 62Y, 62M and 62C for color printing (S30). Specifically, the controller 100 starts the charging bias reduction processing in the early stages of the first inter-sheet period TS1. More specifically, the controller 100 determines, based on information from the sheet sensor SS, whether the first inter-sheet period TS1 has started by determining whether the trailing end of the sheet S printed in the previous print mode has passed the photosensitive drum 61. Then, after it is determined that the first inter-sheet period TS1 has started, the controller 100 starts the charging bias reduction processing at a particular timing.

The controller 100 performs the determination for the first inter-sheet period TS1 and the start of the charging bias reduction processing based on this determination sequentially for each of the colors of Y, M and C. The controller 100 performs, based on the timing at which the first inter-sheet period TS1 starts for each of the colors of Y, M and C, the processing in S31 to S34 described below sequentially for each of the colors of Y, M and C.

After S30, the controller 100 starts the developing bias reduction processing on the developing rollers 63Y, 63M and 63C for color (S31). Specifically, the controller 100 starts the developing bias reduction processing after a first time T11 (see FIG. 5) has elapsed since the start of the charging bias reduction processing. In the present embodiment, the first time T11 is set to the time which it takes for a particular portion on the photosensitive drum 61 charged by the charger 62 to reach the developing roller 63.

After starting the developing bias reduction processing in S31 and during the first inter-sheet period TS1, the controller 100 performs the separation processing (S32). Specifically, in S32, the controller 100 performs the separation processing from the start to the completion thereof.

After ending the separation processing in S32 and during the first inter-sheet period TS1, the controller 100 ends the charging bias reduction processing (S33). After ending the charging bias reduction processing in S33 and during the first inter-sheet period TS1, the controller 100 ends the developing bias reduction processing (S34). After S34, the controller 100 performs image formation processing corresponding to the monochrome printing (S28).

In response to determining in S22 that the print mode is color printing (S22: Yes), that is, when monochrome printing is switched to color printing, the controller 100 starts the charging bias increase processing on the chargers 62Y, 62M and 62C for color printing (S23). Specifically, the controller 100 starts the charging bias increase processing in the early stages of the second inter-sheet period TS2. A determination method relating to the second inter-sheet period TS2 is the same as the determination method relating to the first inter-sheet period TS1 described above. After it is determined that the second inter-sheet period TS2 has started, the controller 100 starts the charging bias increase processing at a particular timing.

The controller 100 performs the determination for the second inter-sheet period TS2 and the start of the charging bias increase processing based on this determination sequentially for each of the colors of Y, M and C. The controller 100 performs, based on timing at which the second inter-sheet period TS2 starts for each of the colors of Y, M and C, the processing in S24 to S27 described below sequentially for each of the colors of Y, M and C.

After S23, the controller 100 starts the developing bias increase processing on the developing rollers 63Y, 63M and 63C for color printing (S24). Specifically, the controller 100 starts the developing bias increase processing after the above-mentioned first time T11 has elapsed since the start of the charging bias increase processing.

After starting the developing bias increase processing in S24 and during the second inter-sheet period TS2, the controller 100 performs the contact processing (S25). Specifically, in S25, the controller 100 performs the contact processing from the start until the completion thereof.

After ending the contact processing in S25 and during the second inter-sheet period TS2, the controller 100 ends the charging bias increase processing (S26). After ending the charging bias increase processing in S26 and during the second inter-sheet period TS2, the controller 100 ends the developing bias increase processing (S27). After S27, the controller 100 performs the image formation processing corresponding to the color printing (S28).

After S28, the controller 100 determines whether there is a sheet S on which printing is to be successively performed (S29). In response to determining in S29 that there is a sheet S on which printing is to be successively performed (S29: Yes), the controller 100 returns to the processing in S21.

In response to determining in S21 that the print mode is the same as the previous print mode (S21: No), the controller 100 performs the image formation processing in the same print mode as the previous print mode without changing the position of the developing roller 63, the charging bias, or the developing bias (S28). In response to determining in S29 that there is no sheet S on which printing is to be successively performed (S29: No), the controller 100 ends the present processing.

An example of the operation of the controller 100 will be described next.

As shown in FIG. 5, when color printing is switched to monochrome printing at the time of successive printing, the controller 100 determines that the first inter-sheet period TS1 has started for yellow at the timing when the trailing end of the sheet S subjected to color printing has passed the photosensitive drum 61Y (time t1). Thereafter, the controller 100 starts the charging bias reduction processing for yellow (time t2).

After the first time T11 has elapsed since time t2, the controller 100 starts the developing bias reduction processing (time t3). After time t3, the controller 100 starts the separation processing (time t4). In this way, the movement of the developing roller 63Y from the contact position to the separation position is started.

Thereafter, when the developing roller 63Y reaches the separation position, the controller 100 ends the separation processing (time t5). After time t5, the controller 100 ends the charging bias reduction processing (time t6). After time t6, the controller 100 ends the developing bias reduction processing (time t7).

In the middle of performing each processing for yellow, in response to determining that the trailing end of the sheet S subjected to color printing has passed the photosensitive drum 61M (time t11), the controller 100 determines that the first inter-sheet period TS1 has started for magenta. Thereafter, the controller 100 performs each processing for magenta as with each processing for yellow.

In the middle of performing each processing for magenta, in response to determining that the trailing end of the sheet S subjected to the color printing has passed the photosensitive drum 61C (time t12), the controller 100 determines that the first inter-sheet period TS1 has started for cyan. Thereafter, the controller 100 performs each processing for cyan as with each processing for yellow.

As shown in FIG. 6, when monochrome printing is switched to color printing at the time of successive printing, the controller 100 determines that the second inter-sheet period TS2 has started for yellow at the timing when the trailing end of the sheet S subjected to the monochrome printing has passed the photosensitive drum 61Y (time t21). Thereafter, the controller 100 starts the charging bias increase processing for yellow (time t22).

After the first time T11 has elapsed since time t22, the controller 100 starts the developing bias increase processing (time t23). After time t23, the controller 100 starts the contact processing (time t24). In this way, the movement of the developing roller 63Y from the separation position to the contact position is started.

Thereafter, when the developing roller 63Y reaches the contact position, the controller 100 ends the contact processing (time t25). After time t25, the controller 100 ends the charging bias increase processing (time t26). After time t26, the controller 100 ends the developing bias increase processing (time t27).

In the middle of performing each processing for yellow, in response to determining that the trailing end of the sheet S subjected to the monochrome printing has passed the photosensitive drum 61M (time t31), the controller 100 determines that the second inter-sheet period TS2 has started for magenta. Thereafter, the controller 100 performs each processing for magenta as with each processing for yellow.

In the middle of performing the processing for magenta, in response to determining that the trailing end of the sheet S subjected to the monochrome printing has passed the photosensitive drum 61C (time t32), the controller 100 determines that the second inter-sheet period TS2 has started for cyan. Thereafter, the controller 100 performs each processing for cyan as with each processing for yellow.

Based on the above, the following effects can be obtained in this embodiment. In the first inter-sheet period TS1, each processing is executed such that the execution period T1 of the separation processing overlaps the execution period T2 of the charging bias reduction processing and the execution period T2 of the developing bias reduction processing. Thus, the interval of sheets S can be shortened. In addition, the charging bias is gradually reduced in the charging bias reduction processing and the developing bias is gradually reduced in the developing bias reduction processing. Thus, even if the charging bias reduction processing or the developing bias reduction processing is executed in a state where the developing roller 63 is in contact with the photosensitive drum 61, the adhesion of the toner from the developing roller 63 to the photosensitive drum 61 can be suppressed. These advantages have been confirmed by experiments.

The first time T11 is set to the time it takes for the particular portion on the photosensitive drum 61 charged by the charger 62 to reach the developing roller 63. With this setting, the developing bias decreases at the time when the particular portion on the surface of the photosensitive drum 61 of which the surface potential is lowered due to the start of the charging bias reduction processing reaches the developing roller 63. This suppresses an increase in the difference between the surface potential of the photosensitive drum 61 and the developing bias. In addition, the developing bias increases at the time when the particular portion of the surface of the photosensitive drum 61 of which the surface potential has increased due to the start of charging bias increase processing reaches the developing roller 63. This suppresses an increase in the difference between the surface potential of the photosensitive drum 61 and the developing bias.

The reduction processing or increase processing of each bias is performed such that the difference of the charging bias and the developing bias is within the first range or the second range, thereby suppressing an increase in the difference between the surface potential of the photosensitive drum 61 and the developing bias.

In the second inter-sheet period TS2, each processing is executed such that the execution period T4 of the contact processing overlaps the execution period T5 of the charging bias increase processing and the execution period T6 of the developing bias increase processing. Thus, the interval of sheets S can be shortened. In addition, the charging bias is gradually increased in the charging bias increase processing and the developing bias is gradually increased in the developing bias increase processing. Thus, even if the charging bias increase processing or the developing bias increase processing is executed in a state where the developing roller 63 is in contact with the photosensitive drum 61, the adhesion of the toner from the developing roller 63 to the photosensitive drum 61 can be suppressed. These advantages have been confirmed by experiments.

While the disclosure has been described in detail with reference to the above aspects thereof, it would be apparent to those skilled in the art that various changes and modifications may be made therein without departing from the scope of the claims.

In the moving mechanism of the above-described embodiment, the rotary motion of the motor is converted into a reciprocating motion by using a cam and cam follower mechanism, and the developing roller is reciprocated between the contact position and the separation position. The mechanism that converts the rotary motion of the motor into the reciprocating motion is not limited to the cam and cam follower mechanism. Other mechanisms that convert a rotary motion into a reciprocating motion, such as a crank-link mechanism, may be used.

In the embodiment, the charger 62 of a non-contact discharge type is illustrated as the charger, but the charger may be, for example, a charging roller that contacts the photosensitive drum.

In the embodiment, the execution period T1 of the separation processing overlaps the execution period T2 of the charging bias reduction processing and the execution period T3 of the developing bias reduction processing, but this disclosure is not limited to this. The execution period of the separation processing may overlap the execution period of at least one of the charging bias reduction processing and the developing bias reduction processing. Similarly, the execution period of the contact processing may overlap the execution period of at least one of the charging bias increase processing and the developing bias increase processing.

In the embodiment, this disclosure is applied to the color printer 1. However, this disclosure is not limited to this, and may be applied to another image forming apparatus, such as a copier and a multifunction peripheral.

The elements described in the above embodiments and modifications may be combined as appropriate.

What is claimed is:

1. An image forming apparatus configured to form an image on a sheet, comprising:

a first photosensitive drum;

a first developing roller movable between a contact position at which the first developing roller contacts the first photosensitive drum and a separation position which is apart from the contact position;

a first charger configured to charge the first photosensitive drum;

a second photosensitive drum;

a second developing roller;

a second charger configured to charge the second photosensitive drum;

a moving mechanism configured to move the first developing roller between the contact position and the separation position; and a controller configured to switch a printing mode between a color mode in which the first and second developing rollers are at contact positions at which the first and second developing rollers contact the first and second photosensitive drums, respectively, and a monochrome mode in which the first developing roller is at the separation position and the second developing roller is at the contact position, wherein the controller is configured to:

determine whether an image forming in the color mode is performed on a first sheet and then an image forming in the monochrome mode is successively performed on a second sheet; and in response to determining that the image forming in the color mode is performed on the first sheet and then the image forming in the monochrome mode is successively performed on the second sheet, perform charging bias reduction processing and developing bias reduction processing during a first inter-sheet period after the first sheet passes the first photosensitive drum and before the second sheet reaches the first photosensitive drum, the charging bias reduction processing being processing of gradually reducing a charging bias applied to the first charger from a first charging bias to a second charging bias, the developing bias reduction processing being processing of gradually reducing a developing bias applied to the first developing roller from a first developing bias to a second developing bias; and perform separation processing such that an execution period of the separation processing overlaps at least one of an execution period of the charging bias reduction processing and an execution period of the developing bias reduction processing, the separation processing being processing of controlling the moving mechanism to move the first developing roller from the contact position to the separation position.

2. The image forming apparatus according to claim 1, wherein the controller is configured to, in the first inter-sheet period, start the developing bias reduction processing after an elapse of a first time after starting the charging bias reduction processing.

3. The image forming apparatus according to claim 2, wherein the first time is a time that takes for a particular portion on the first photosensitive drum charged by the first charger to reach the first developing roller.

4. The image forming apparatus according to claim 3, wherein the controller is configured to perform the charging bias reduction processing and the developing bias reduction processing such that a difference between the charging bias and the developing bias is within a first range.

5. The image forming apparatus according to claim 1, wherein the controller is configured to, in the first inter-sheet period, start the separation processing after starting the developing bias reduction processing.

6. The image forming apparatus according to claim 1, wherein the controller is configured to, in the first inter-sheet period, end the charging bias reduction processing after ending the separation processing.

7. The image forming apparatus according to claim 1, wherein the controller is configured to, in the first inter-sheet period, end the developing bias reduction processing after ending the charging bias reduction processing.

8. The image forming apparatus according to claim 1, wherein the controller is configured to perform the separation processing such that the execution period of the separation processing overlaps both of the execution period of the charging bias reduction processing and the execution period of the developing bias reduction processing.

9. The image forming apparatus according to claim 1, wherein the controller is configured to:

in the charging bias reduction processing, reduce the charging bias from the first charging bias suitable for image forming to the second charging bias lower than the first charging bias with a first gradient; and in the developing bias reduction processing, reduce the developing bias from the first developing bias suitable for image forming to the second developing bias lower than the first developing bias with a second gradient; and wherein the first gradient and the second gradient are set to a same gradient.

10. The image forming apparatus according to claim 1, wherein the controller is configured to:

start the charging bias reduction processing;

after starting the charging bias reduction processing, start the developing bias reduction processing;

after starting the developing bias reduction processing, perform the separation processing;

after performing the separation processing, end the charging bias reduction processing; and after ending the charging bias reduction processing, end the developing bias reduction processing.

11. The image forming apparatus according to claim 1, wherein the controller is further configured to:

determine whether the image forming in the monochrome mode is performed on a third sheet and then the image forming in the color mode is successively performed on a fourth sheet; and in response to determining that the image forming in the monochrome mode is performed on the third sheet and then the image forming in the color mode is successively performed on the fourth sheet, perform charging bias increase processing and developing bias increase processing during a second inter-sheet period after the third sheet passes the first photosensitive drum and before the fourth sheet reaches the first photosensitive drum, the charging bias increase processing being processing of gradually increasing the charging bias applied to the first charger from the second charging bias to the first charging bias, the developing bias increase processing being processing of gradually increasing the developing bias applied to the first developing roller from the second developing bias to the first developing bias, and perform contact processing such that an execution period of the contact processing overlaps at least one of an execution period of the charging bias increase processing and an execution period of the developing bias increase processing, the contact processing being processing of controlling the moving mechanism to move the first developing roller from the separation position to the contact position.

12. The image forming apparatus according to claim 11, wherein the controller is configured to, in the second inter-sheet period, start the developing bias increase processing after an elapse of a first time after starting the charging bias increase processing.

13. The image forming apparatus according to claim 12, wherein the first time is a time that takes for a particular portion on the first photosensitive drum charged by the first charger to reach the first developing roller.

14. The image forming apparatus according to claim 13, wherein the controller is configured to perform the charging bias increase processing and the developing bias increase processing such that a difference between the charging bias and the developing bias is within a second range.

15. The image forming apparatus according to claim 11, wherein the controller is configured to, in the second inter-sheet period, start the contact processing after starting the developing bias increase processing.

16. The image forming apparatus according to claim 11, wherein the controller is configured to, in the second inter-sheet period, end the charging bias increase processing after ending the contact processing.

17. The image forming apparatus according to claim 11, wherein the controller is configured to, in the second inter-sheet period, end the developing bias increase processing after ending the charging bias increase processing.

18. The image forming apparatus according to claim 11, wherein the controller is configured to perform the contact processing such that the execution period of the contact processing overlaps both of the execution period of the charging bias increase processing and the execution period of the developing bias increase processing.

19. The image forming apparatus according to claim 11, wherein the controller is configured to:

in the charging bias increase processing, increase the charging bias from the second charging bias to the first charging bias suitable for image forming with a first gradient; and in the developing bias increase processing, increase the developing bias from the second developing bias to the first developing bias suitable for image forming with a second gradient; and wherein the first gradient and the second gradient are set to a same gradient.

20. The image forming apparatus according to claim 11, wherein the controller is configured to:

start the charging bias increase processing;

after starting the charging bias increase processing, start the developing bias increase processing;

after starting the developing bias increase processing, perform the contact processing;

after performing the contact processing, end the charging bias increase processing; and after ending the charging bias increase processing, end the developing bias increase processing.

* * * * *